United States Patent [19]

Kamp

[11] Patent Number: 4,581,007

[45] Date of Patent: Apr. 8, 1986

[54] ADHESIVE CLOSURE BAGS AND METHOD FOR PRODUCING SAME

[75] Inventor: Ewald A. Kamp, Chicago, Ill.

[73] Assignee: Union Carbide Corporation, Danbury, Conn.

[21] Appl. No.: 679,210

[22] Filed: Dec. 7, 1984

Related U.S. Application Data

[62] Division of Ser. No. 453,170, Dec. 27, 1982, Pat No. 4,513,445.

[51] Int. Cl.[4] ..... B31B 1/62

[52] U.S. Cl. ..... 493/264; 493/223; 493/248

[58] Field of Search ..... 493/221, 223, 224, 228, 493/229, 230, 231, 232, 233, 235, 237, 238, 239, 240, 243, 245, 248, 260, 264; 156/200–202, 204, 227, 272.6, 66, 291

[56] References Cited

U.S. PATENT DOCUMENTS

| | | | |
|---|---|---|---|
| 3,067,119 | 12/1962 | Ramaika | 156/272.6 |
| 3,420,433 | 1/1969 | Bostwick | 229/80 |
| 3,519,197 | 7/1970 | Campbell | 229/66 |
| 3,599,538 | 8/1971 | Piazze | 493/235 |
| 3,942,713 | 3/1976 | Olson et al. | 229/62 |
| 3,990,627 | 11/1976 | Olson | 229/62 |
| 4,181,069 | 1/1980 | Porter | 493/233 |
| 4,394,955 | 7/1983 | Raines et al. | 383/86 |

*Primary Examiner*—Francis S. Husar
*Assistant Examiner*—Robert Showalter
*Attorney, Agent, or Firm*—Roger Aceto

[57] ABSTRACT

An adhesive closure bag with a Z-folded flap, together with a method of production thereof.

6 Claims, 13 Drawing Figures

ADHESIVE CLOSURE BAGS AND METHOD FOR PRODUCING SAME

This application is a division of prior U.S. application Ser. No. 453,170, filed on Dec. 27, 1982, Pat. No. 4,513,445.

FIELD OF THE INVENTION

The present invention relates generally to plastic bags and more specifically, to an adhesive closure bag with a Z-folded flap, together with a method of production thereof.

BACKGROUND OF THE INVENTION

The art with respect to plastic bags, and their production from continuous webs, is well-developed. By way of illustration, U.S. Pat. No. 3,420,433 discloses a bag having a U-folded closure flap. The closure flap of that patent has an adhesive stripe on the inner portion of the flap covered by the U-fold.

As an additional illustration of the art, U.S. Pat. No. 3,519,197 discloses a bottom gusseted bag having a Z-folded top portion which forms the mouth of the bag. The Z-fold of that patent contains a line of weakness that may be torn readily to permit access to the interior of the bag.

As yet another illustration of the prior art, U.S. Pat. No. 3,990,627 discloses, in FIG. 4 thereof, an adhesive closure bag with a Z-folded flap. However, no method of making the bag of that patent is disclosed therein.

As still another illustration of the prior art, U.S. Pat. No. 3,942,713 discloses a double-flapped bag wherein the rear flap forms a pouch and wherein the front flap has an adhesive strip on the inner portion of the flap covered by a Z-fold.

In view of the commercial importance of plastic bags, there exists a considerable need for new types of bags and methods for making them.

OBJECTS OF THE INVENTION

It is an object of the invention to provide an adhesive bag with a Z-folded flap suitable for use in packaging food products and other household items.

It is another object of the invention to provide a method of automatically and continuously making adhesive closure bags with Z-folded flaps.

These and other objects will become apparent by a reading of the following detailed specification.

SUMMARY OF THE INVENTION

In one aspect, the present invention relates to a bag of the type used for packaging sandwiches and other food products which comprises two superimposed wall members of a thin, flexible, plastic material, including a front wall member and a rear wall member, joined together at the peripheral edges thereof to form a bag having an open bag mouth, a closure flap extending from said rear wall member beyond said bag mouth and adapted to be drawn over said bag mouth and into contact with said front wall member in order to close the bag, and an adhesive applied to said closure flap (i.e., the side which is on the inside of the flap when closed) for adhering said flap to said front wall member, said closure flap being folded upon itself into a Z-fold with said adhesive disposed on one superimposed portion and releasably adhering to another superimposed portion of the Z-folded flap, thereby substantially covering said adhesive and protecting it from contact with air and other exterior objects, and at least the portion of said closure flap comprising a Z-fold having a flap width that is less than the bag width.

In another aspect, the present invention encompasses a method of making adhesive closure bags with Z-folded flaps which comprises the steps of:

(a) J-folding a continuous plastic web to provide a superimposed folded portion on a flap portion;
(b) surface treating at least one region of the flap portions to render said region more receptive to an adhesive than the remaining plastic in said web;
(c) applying adhesive to said surface treated region;
(d) Z-folding a part of said flap portion to cover said adhesive;
(e) removing a portion of the Z-fold at spaced longitudinal intervals thereby establishing the longitudinal interfaces selected for transversely dividing said web into a plurality of plastic bags; and
(f) sever-sealing the J-fold of the web in the transverse direction in the region of each of said spaced intervals to seal and sever the longitudinal interface between individual bags of said plurality and thereby produce a plurality of Z-folded closure bags having unsealed Z-folded edges.

In order to be fully automatic and continuous, this method additionally comprises the step of repeating steps (a) through (f) in an automatic and continuous fashion.

In still another aspect, the present invention encompasses a method of making adhesive closure bags with Z-folded flaps which comprises the steps of:

(a) C-folding a continuous plastic web to provide a pair of superimposed folded web portions joined by a flat web portion thereinbetween;
(b) surface treating at least two regions of the flat web portion in said C-fold to render said regions more receptive to an adhesive than the remaining plastic in said web;
(c) applying adhesive to said more receptive regions;
(d) Z-folding portions of said flat web portion over said adhesive covered regions;
(e) bisecting the C-folded web longitudinally along the flat web portion to produce two individual J-folded webs, each having one of said Z-folded portions, to thereby facilitate the simultaneous production of two J-folded tandem rows of bags.
(f) removing a portion of the Z-folds, at spaced intervals marking the longitudinal interfaces selected for dividing each J-folded web into a plurality of plastic bags;
(g) sever-sealing the J-fold in the region of said spaced intervals to seal and sever the longitudinal interface between individual plastic bags of said plurality, and therby produce a plurality of Z-folded adhesive closure bags;

In order to be fully automatic and continuous, this method additionally comprises the step of repeating steps (a) through (g) in an automatic and continuous fashion. In regard to making the bags using a C-folded web, the steps of (d) (Z-folding) and (e) (bisecting) can be performed in interchangeable sequence.

DETAILED DESCRIPTION OF THE INVENTION

Although the invention is applicable to a number of different types of flat bags, the novel features and advantages thereof are particularly useful in flat bags of the adhesive closure Z-fold type used for packaging freshly prepared sandwiches, pastries, bread and other food products. The bags are also useful for storing and protecting household items including silverware, salt shakers, candles, and the like. With this in mind, the preferred embodiments of the invention will now be described in connection with the flat bag illustrated in the several figures of the accompanying drawing.

Figure 1:
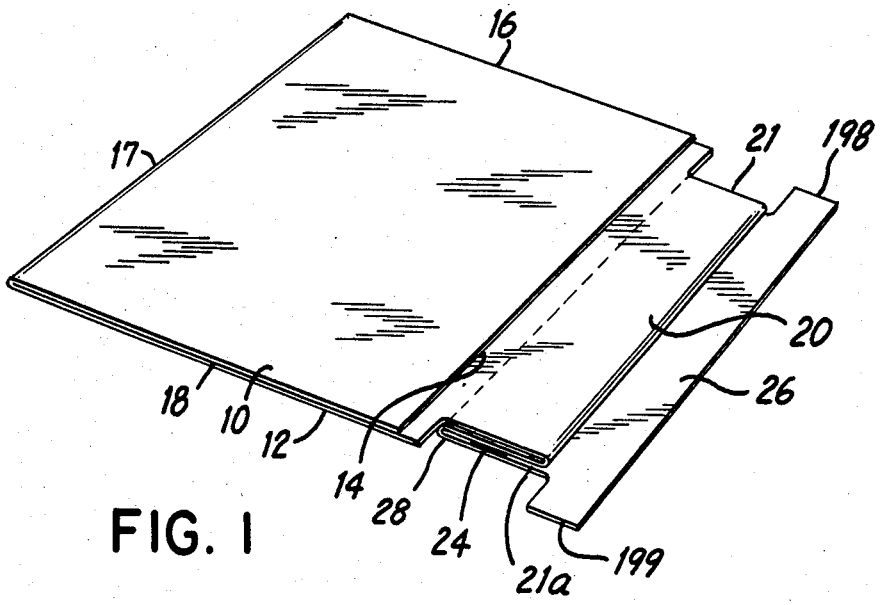
FIG. 1 is an isometric view of a bag embodying the invention, showing the notched Z-folded closure flap.

Referring now to FIG. 1, there is illustrated a preferred embodiment of an adhesive closure bag of the invention. As illustrated, the bag is formed of two flat superimposed front and rear wall members 10, 12 which are made from a thin flexible plastic film material. Both the front and rear walls 10, 12 overlie one another in a substantially flatwise manner and are joined together at the edges except at one edge which is left open to constitute a bag mouth as indicated at 14. The bag is preferably made from a single sheet or web of the plastic film material such as a polyethylene film, for example, which is folded upon itself along a fold line 17 at the bottom of the bag and then joined at the opposite edges suitably by heat sealing the plastic film as shown at 16, 18.

Figure 1A:
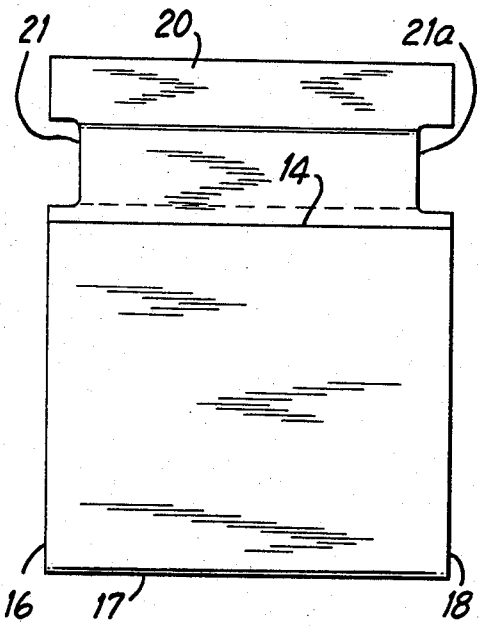
FIGS. 1*a* and 1*b* are plan views of a bag showing notched closure flaps.
Figure 1B:
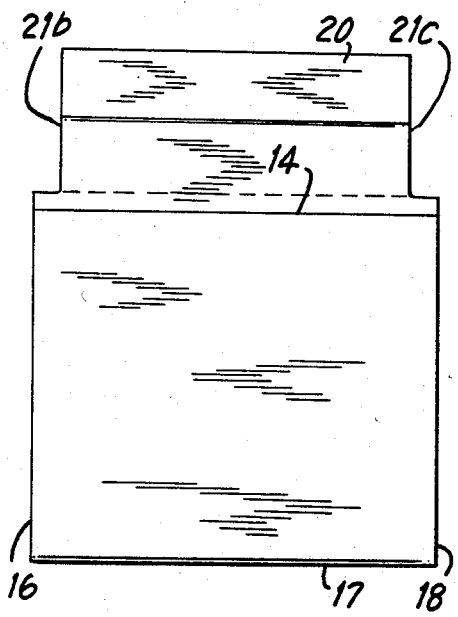
Figure 3:
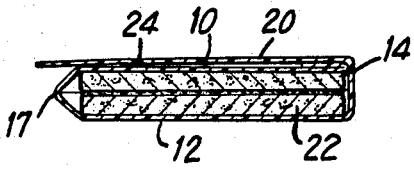
FIG. 3 is a cross-sectional view of the bag in a closed position.

As illustrated in FIG. 1, the bag is provided with a notched, Z-folded closure flap 20 for sealing a sandwich or other food product within the bag. The closure flap 20 is formed by an extension of the rear wall 12 beyond the top of the bag a sufficient distance so that the flap 20 may be drawn over the bag mouth 14 after the sandwich 22 (see FIG. 3) has been placed within the bag, and the flap may then be folded onto a substantial portion of the front wall 10 of the bag. FIG. 1*a* shows a plan view of the bag of FIG. 1. FIG. 1*b* shows a plan view of an alternate embodiment of a bag wherein closure flap 20*a* is fully notched as indicated by notches 21*b*, 21*c*. FIG. 3 shows a closed bag containing sandwich 22. In order to secure the closure flap 20 to the front wall 10, an adhesive 24 is applied to the underneath side of the flap 20 (i.e., the side which is on the inside of the flap when closed) preferably in the form of a continuous adhesive stripe 24 extending across the full width of the flap 20. Although the continuous adhesive stripe 24 is preferred for use in the bag, the adhesive may be provided in other forms such as a discontinuous stripe or a single adhesive patch applied to the underneath side of the flap 20. Preferably, the adhesive stripe 24 is applied in proximity to the edge of the closure flap 20, still leaving a free end 26 for grasping by the user when it is desired to open the bag and also for grasping to eliminate the Z-fold from the flap to expose the adhesive prior to closing the bag.

The adhesive which is used to secure the closure flap 20 to the front wall 10 of the bag is preferably of the pressure-sensitive type. With a pressure-sensitive adhesive, it is a simple matter to seal the bag by applying pressure with the user's finger across the full width of the closure flap 20 after it has been folded onto the front wall 10 of the bag. A pressure-sensitive adhesive is preferred for bags which are to be reopened, such as for sandwich bags. However, for bags which are not intended for reopening, such as trash bags or disposable diaper bags, any type of adhesive may be used.

Suitable pressure-sensitive adhesives for use in the bag may include acrylic, natural and synthetic rubber types. The adhesive may be applied to the closure flap 20 to a controlled uniform thickness of approximately 0.1 to 0.5 mil depending upon the type of adhesive employed and the nature of the additives therein, using conventional application techniques such as flexographic printing, wound wire bar coating, knife coating, extrusion coating, or other methods, depending upon the adhesive chosen. The adhesive could be a hot melt type, either heat activated or pressure sensitive, depending upon the end use. The adhesive may also be a solvent based liquid adhesive, including acrylate, rubber or urethane based pressure sensitives. They may also be based on latex formulations. For end uses, such as sandwich bags, acrylic latexes, such as UCAR-152, a product of Union Carbide Corp., are commercially available to produce pressure sensitive adhesives by properly blending the latex with any of a variety of commercial packyfiers.

Treatment of the surface of the portion of the flap where the adhesive is to be applied is well known in the art. Such treatment may be made by corona discharge, chemical treatment or flame oxidation. The purpose of the pre-treatment is to insure that the adhesive has a surface affinity for the plastic flap film to which it is applied that is greater than the affinity for the film making up the remainder of the bag. In a preferred aspect of the invention, when using acrylate latexes and a plastic web having a wettability of 30 dynes/centimeter or less to make a bag, the wettability of the pre-treated surface of the portion of the bag flap where the adhesive is to be applied should be in the range of about 37 to about 40 dynes/centimeter.

According to the novel features of the invention, during assembly of the bag, the closure flap 20 is folded upon itself to form a Z-folded overflap at the top of the bag, which is located just above the bag mouth 14 as generally indicated at 28 in FIG. 1. This flap closure is formed by folding a portion of the closure flap 20 containing the adhesive stripe 24 against the underneath side of the upper half such that the adhesive stripe 24 is substantially disposed between the folded portions of the flap 20. FIGS. 2*a*, 2*b*, 2*c* and 2*d* provide cross-sectional views of a bag showing adhesive stripe 24 in various positions within Z-folded flap 20. As shown adhesive stripe 24 is disposed on one superimposed flap portion 333, 333*a*, 333*b* or 333*c* and releasably adheres to another superimposed flap portion 334, 334*a*, 334*b* or 334*c* respectively. FIG. 2*a* shows a bag embodiment having a bottom gusset 17*a*. In constructing the bag, the Z-fold insures that the lower half of the flap 20 is such that the free end 26 of the flap 20 is disposed above the bag mouth 14. In this manner, the free end 26 of the closure flap 20 is placed in a readily accessible position for grasping by the user for purposes of opening and closing the bag.

By forming the Z-fold in the closure flap, it will be seen that a protective enclosure is provided for the adhesive. This protective enclosure protects the adhesive from coming into contact with adjacent bags when packaged within a dispensing carton and from inadvertently contacting any exterior object once the bag is removed from the carton, such as during insertion of a sandwich.

Figure 4:
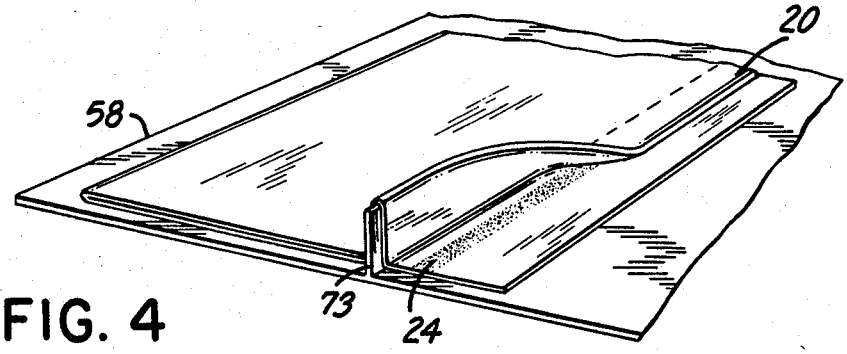
FIG. 4 is an isometric view of a web of plastic with adhesive stripe on a Z-fold partially separated to illustrate the method of making the Z-folded flap bag.

The folds of the flap portion in a Z-fold configuration serve several important functions. First, as stated above, the Z-fold protects the adhesive itself and prevents contact of the adhesive with unwanted foreign objects prior to closure of the bag and prior to use of the adhesive to seal the flap of the bag. Second, the Z-fold facilitates opening the bag flap by providing the free end of the flap in a convenient position at the terminal edge of the flap. Third, the use of a Z-fold eliminates the requirement for a release strip to protect the adhesive prior to bag use. The Z-fold also provides a convenient and practical means to cover the adhesive by simple fixed folder means which accomplishes the turning of the web onto the adhesive stripe without having mechanical or guide parts come into contact with the coated area of the flap. Such means is shown in FIG. 4

Another important advantage of the invention resides in the fact that the adhesive is not exposed until the moment of use. During assembly of the bag, the adhesive is made to adhere firmly to the superimposed portion of the folded closure flap 20. With a pressure-sensitive adhesive this is easily accomplished by simply applying pressure across the folded portion of the flap 20. Since the adhesive is substantially protected by contact with the superimposed portions of the flap 20, it is effectively shielded from exposure to the atmosphere and is thus less subject to deterioration or loss of tenacity than would be an unprotected adhesive during the period in which the bag is stored within the dispensing carton prior to use.

Flap notches 21, 21*a* as shown in FIG. 1 are preferably produced by slot punching prior to sever-sealing the sides of the bag. Removal of the edge material of the Z-fold by punching prior to sever-sealing to produce individual bags, serves to prevent sealing the edges of the Z-fold thereby facilitating unfolding the Z-fold at the time of bag use.

Figure 2:
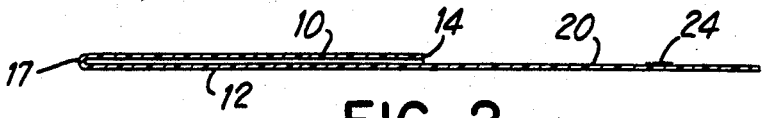
FIG. 2 is a cross-sectional view of the bag with its flap in a fully opened position.
Figure 2A:
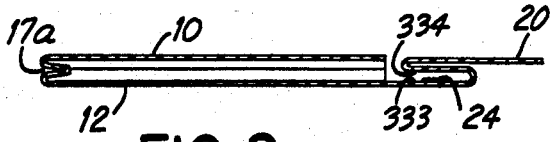
FIGS. 2*a*, 2*b*, 2*c* and 2*d* are cross sectional views of a bag showing adhesive stripe positions within a Z-folded flap.
Figure 2B:
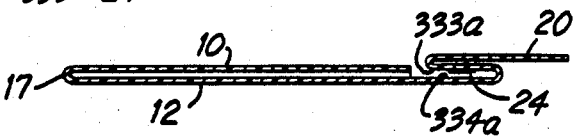
Figure 2C:
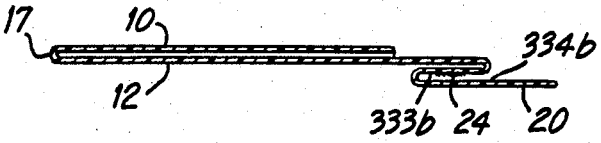
Figure 2D:
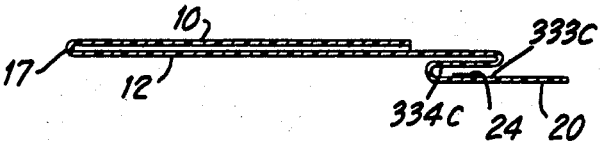

FIG. 2 provides a cross-sectional view of a bag with the Z-fold on flap 20 completely eliminated. The bag is ready for folding the flap over the bag mouth to seal the mouth after filling the bag with a sandwich or other item.

The method of making the Z-fold for the adhesive closure sandwich bags of the present invention is illustrated in FIG. 4. The method employs a J-folded web 58, a portion of which passes over a stationary guide 73 while an adhesive stripe 24 is being applied to another portion of the web 58. The stationary guide 73 facilitates Z-folding of the flap 20 immediately after application of the adhesive stripe 24 as best illustrated in FIG. 4. FIG. 4 shows a useful method of making a Z-fold in a web which comprises drawing a portion of the web 58 over stationary guide 73, thereby forming a Z-fold. Stationary guide 73 is disposed at a right angle to the angle formed by the plane of the web.

Figure 5:
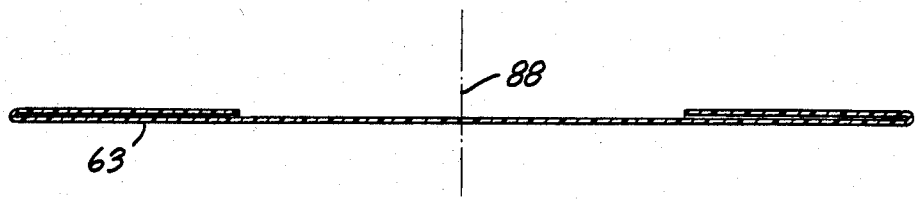
FIG. 5 is a cross-sectional view of a C-folded web of plastic.
Figure 6:
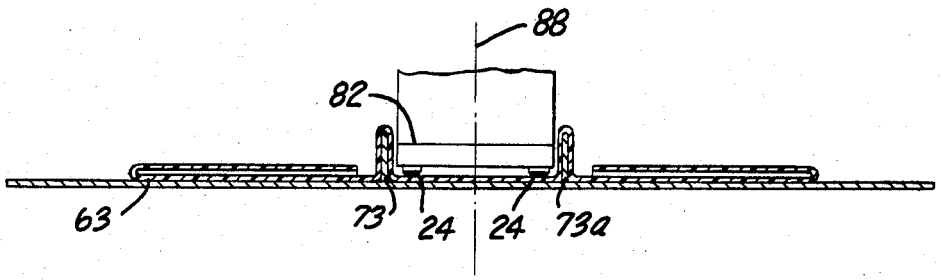
FIG. 6 is a cross-section of the C-folded web showing Z-folding guides and an adhesive application device.

FIG. 6 illustrates the method of making "two-up" bags from a C-folded web 63. A typical C-folded web 63 is shown in FIG. 5. When using a C-fold, two stationary guides 73, 73*a* are suitably employed. Adhesive is preferably applied to the single layer of film which forms the bag flaps via an adhesive application device 82 which applies two adhesive stripes 24. As is known in the art, the C-fold is bisected at a web center line 88 to produce two bags, in contrast only a single bag is produced using the J-fold method of FIG. 4.

Figure 7:
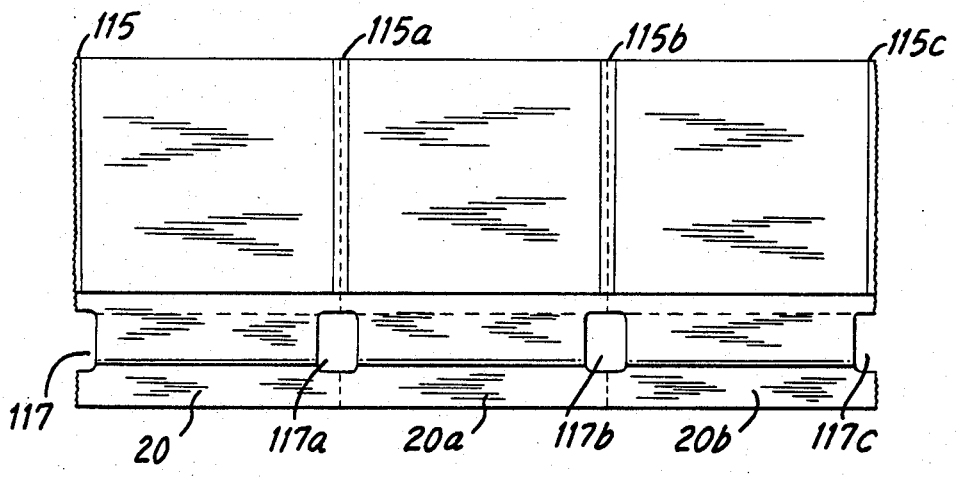
FIG. 7 is a plan view of a plurality of Z-folded bags of the present invention.

FIG. 7 provides a plan view of a plurality of Z-folded flap bags illustrating sever seals 115, 115*a*, 115*b* and 115*c* and slot punches 117, 117*a*, 117*b* and 117*c*. Note that the slot punching serves to prevent the sealing of the Z-folds in flaps 20, 20*a* and 20*b* when the bag edges are sealed at 115, 115*a*, 115*b*, 115*c*.

Sever-sealing is the preferred method of producing bag side wall seals in accordance with the present invention. As used herein, the term sever sealing is intended to encompass all methods of simultaneously producing two side sealed edges with a separation between the edges. Thus, the term sever sealing would include conventional hot knife sealers as well as hot wire sealers and mixed sealers consisting of two bar seals with a cutoff between the bar seals.

As used herein the term "Z-fold" is used to designate a bag flap folded in a Z-configuration and containing adhesive within and protected by at least one of the folds, as illustrated by flap 20 of FIG. 1. Z-folds are further described in U.S. Pat. No. 3,990,627, incorporated herein by reference.

As used herein the terms "J-fold" and "C-fold" are applied to web folds as illustrated in FIGS. 2 and 5, respectively.

As used herein, the term "bag width" is the width as typically illustrated in FIG. 1 measured from edge 16 to opposite edge 18.

As used herein, the term "flap width" is the width as typically illustrated in FIG. 1 measured from flap edge 198 to opposite flap edge 199.

A typical sandwich bag within the scope of the present invention would be one having a bag width of $6\frac{1}{4}$ inches, a flap width of $6\frac{1}{4}$ inches, a flap length above the mouth of the bag of $2\frac{1}{4}$ inches, the flap being Z-folded to cover a $\frac{1}{4}$ inch wide adhesive strip running the width of the flap. In this bag, the adhesive stripe is typically positioned $\frac{1}{2}$ inch from the free end of the flap, and the flap is typically notched $\frac{1}{8}$ inch into the flap on each side using a $\frac{1}{4}$ inch slot punch.

While the preferred embodiments of this invention have been disclosed hereinabove, those skilled in the art will appreciate that changes and modifications may be made therein without departing from the spirit and scope of the invention.

I claim:

1. A method of making adhesive closure bags with Z-folded flaps which comprises the steps of:

(a) J-folding a continuous plastic web to provide a superimposed folded portion on a flap portion;

(b) surface treating at least one region of the flap portion to render said region more receptive to an adhesive than the remaining plastic in said web;

(c) applying adhesive to said surface treated region;

(d) Z-folding a part of said flap portion to cover said adhesive;

(e) removing a portion of the Z-fold at spaced longitudinal intervals thereby establishing the longitudinal interfaces selected for transversely dividing said web into a plurality of plastic bags; and (f) sever-sealing the J-fold of the web in the transverse direction in the region of each of said spaced intervals to seal and sever the longitudinal interface between individual bags of said plurality and thereby produce a plurality of Z-folded adhesive closure bags having unsealed Z-folded edges.

thereby produce a plurality of Z-folded adhesive closure bags having unsealed Z-fold edges.

2. The method of claim 1 which additionally comprises the step of repeating steps (a) through (f) in an automatic and continuous fashion.

3. A method of making adhesive closure bags with Z-folded flaps which comprises the steps of:

(a) C-folding a continuous plastic web to provide a pair of superimposed folded web portions joined by a flat web portion thereinbetween;

(b) surface treating at least two regions of the flat web portion in said C-fold to render said regions more receptive to an adhesive than the remaining plastic in said web;

(c) applying adhesive to said more receptive regions;

(d) Z-folding portions of said flat web portion over said adhesive covered regions;

(e) bisecting the C-folded web longitudinally along the flat web portion to produce two individual J-folded webs, each having one of said Z-folded portions, to thereby facilitate the simultaneous production of two tandem rows of bags;

(f) removing a portion of the Z-folds, at spaced intervals marking the longitudinal interfaces selected for dividing each J-folded web into a plurality of plastic bags;

(g) sever-sealing the J-fold in the region of said spaced intervals to seal and sever the longitudinal interface between individual plastic bags of said plurality and thereby produce a plurality of Z-folded adhesive closure bags having unsealed Z-fold edges.

4. The method of claim 3 which additionally comprises the step of repeating steps (a) through (g) in an automatic and continuous fashion.

5. The method of claim 3 which includes after step (a), gusseting at least one fold of said C-fold at the fold of said superimposed folded web portion.

6. The product produced by the method of any one of claims 2 through 5.

* * * * *